United States Patent [19]

Berard et al.

[11] 4,133,140

[45] Jan. 9, 1979

[54] SAFETY MECHANISM FOR HIGHWAY EXIT RAMP

[75] Inventors: Louis N. Berard; Alfred G. Hollmann; Leonard A. Stein, all of St. Louis, Mo.

[73] Assignee: Devices Development Corporation, St. Louis, Mo.

[21] Appl. No.: 631,830

[22] Filed: Nov. 14, 1975

[51] Int. Cl.[2] ..... E01F 13/00

[52] U.S. Cl. ..... 49/49; 49/264

[58] Field of Search ..... 49/31, 49, 141, 192, 49/263–271; 246/125, 125.5; 340/15.5 R, 31 R, 45

[56] References Cited

U.S. PATENT DOCUMENTS

| | | | |
|---|---|---|---|
| 1,531,987 | 3/1925 | Smith | 246/125.5 |
| 1,812,559 | 6/1931 | Sampson | 49/192 |
| 1,914,359 | 6/1933 | Butts | 49/264 |
| 2,687,588 | 9/1954 | Nutter | 49/31 |
| 3,325,782 | 6/1967 | Der | 340/31 R |
| 3,823,510 | 7/1974 | Panaccione | 49/192 |

*Primary Examiner*—Peter M. Caun
*Attorney, Agent, or Firm*—Paul M. Denk

[57] ABSTRACT

In a safety mechanism for highway exit ramp, dual motions are provided in the structural operation of the mechanism wherein a warning member, such as a length of barrier or semaphore, is pivotally mounted between an upright position and into a horizontal and cautioning disposition across the roadway, but in addition, the warning member itself is horizontally pivotal in the event that a moving vehicle should strike the same. The mechanism includes a detection member, such as either a protruding device capable of being pivoted by the vehicle passing thereover, or an electronic detecting device as provided in the roadbed of the ramp and when encountered by a vehicle travelling in the wrong direction disengages a detent that releases a spring mounted rack that turns its pinion for pivoting the warning device across the roadway. The horizontal pivot to the warning device is acquired by means of another pinion mounted to a cylindrical member that supports the warning device, and this pinion engages with a rack that is spring biased for normally centering the warning device perpendicularly across the roadway of the ramp, but which is capable of being pivoted out of this perpendicular orientation as when encountered by a vehicle.

13 Claims, 8 Drawing Figures

FIG. 4
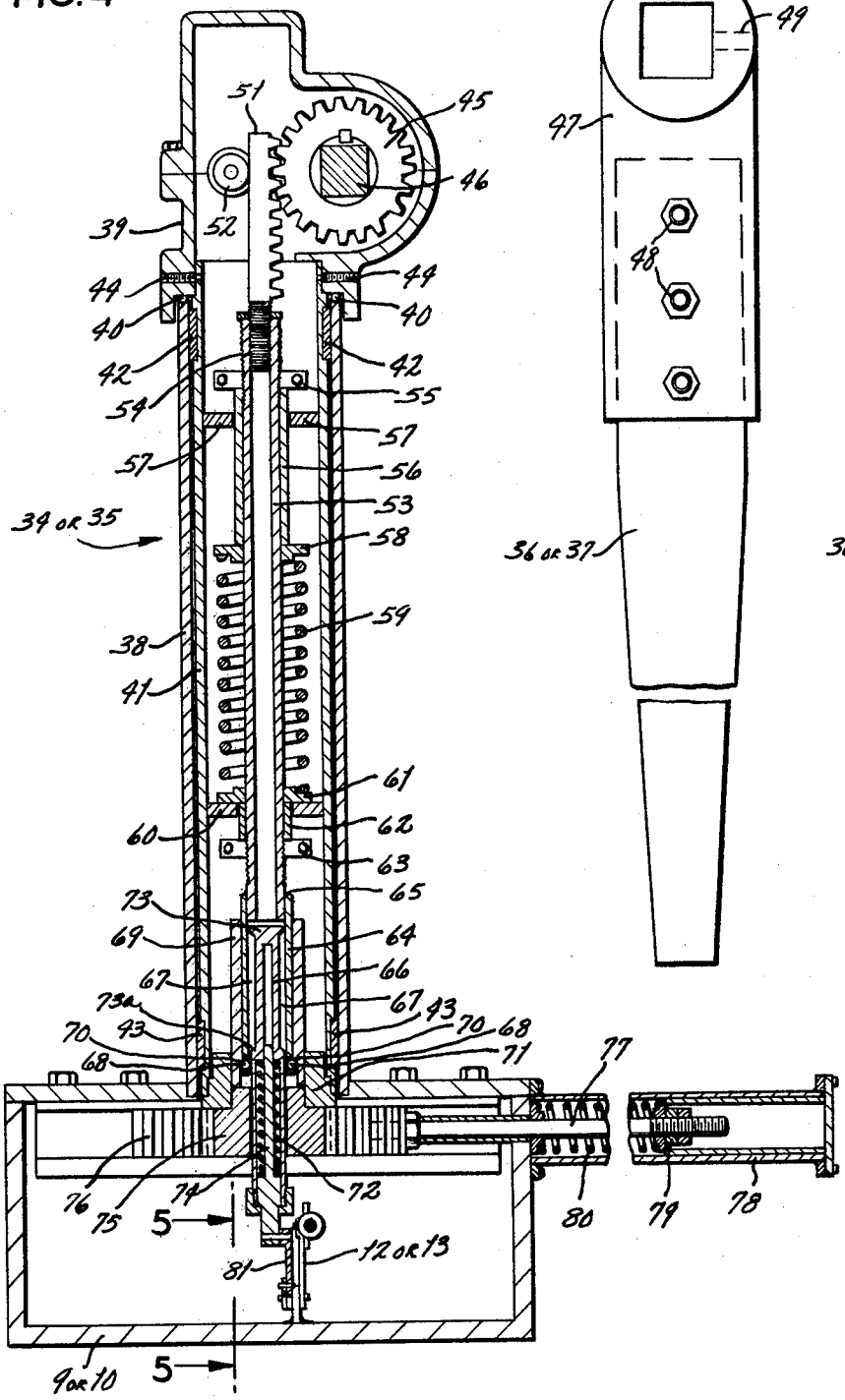
FIG.6
FIG.7
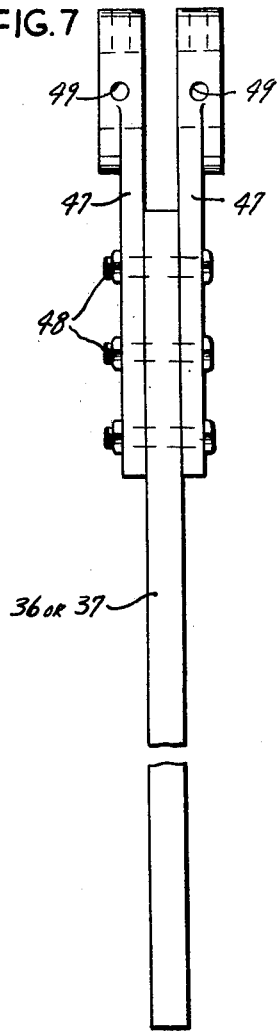
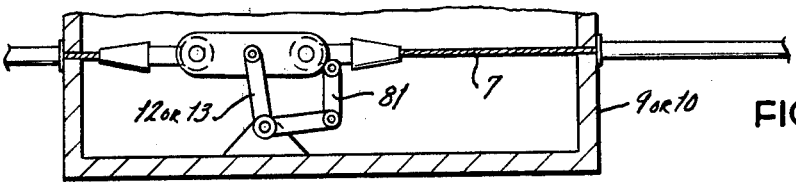
FIG. 5

SAFETY MECHANISM FOR HIGHWAY EXIT RAMP

BACKGROUND OF THE INVENTION

This invention relates generally to a safety mechanism for a highway exit ramp, but more particularly, pertains to a warning device that is actuated into a barrier disposition across the roadway when its detection means senses the presence of a vehicle travelling incorrectly upon the ramp.

Many styles and various types of vehicle barriers are provided in the prior art, and generally these barriers are of the type that are utilized in conjunction with parking lots, for allowing egress or exit from the same, generally upon the payment of the stipulated parking fee. One such device is shown in the United States patent to Castle, U.S. Pat. No. 3,741,859. This shown device includes a barrier member that is normally inclined in its mounting upon the surface of the ground, as when vehicles pass in one direction, but precludes movement of the vehicle in an opposite direction. Many styles of these type of devices have been incorporated into ramps used as approaches for freeways, generally to prevent vehicle access in the wrong direction, most of these devices are mounted directly within the ground rather than providing a barrier across the roadway approximately at the eye level of the driver. Two of these devices are shown in the United States patent to Schmidt, U.S. Pat. No. 3,266,013, and the United States patent to Der, U.S. Pat. No. 3,325,782.

Of more recent design is the method and apparatus for detering wrong way drivers upon a one-way road, as shown in the United States patent to Griebel, U.S. Pat. No. 3,876,973, but the device shown is structured as a diverting or deflecting mechanism, rather than just a warning device that extends perpendicularly across the roadway.

In view of the foregoing, it is the principal object of the current invention to provide a warning that may be arranged perpendicularly across the exit ramp of a roadway, or even a one-way street, and which is actuated upon sensing the movement of a vehicle moving in the wrong direction.

A further object of this invention is to provide means for arranging a plurality of warning devices across a roadway so as to provide full notice to a driver that he is moving his vehicle in the wrong direction upon the same.

Another object of this invention is to provide a warning device for alerting the driver of a vehicle that his vehicle is travelling in an incorrect direction, and which device incorporates a plurality of movements so as to achieve both the proper degree of warning but yet cause little or no damage to a vehicle that may collide with the same.

A further object of this invention is to provide a warning device for an exit ramp of a highway that may be actuated by detecting means that are either of a mechanical or electrical design.

A further object of this invention is to provide a complete barrier for disposition across a roadway which displays or openly incorporates little or no operating components other than its pivotally mounted warning device.

A further object is to provide a safety mechanism for a highway that is uniform of appearance, and blends aesthetically with the surrounding roadway environment.

A further object of this invention is to provide a safety mechanism for a highway that is reasonably compact in construction, and can be completely fabricated at the plant site for transfer and easy installation at the roadway.

Other objects will become more apparent to those skilled in the art upon reviewing the summary of the invention, and upon a study of the construction of the preferred embodiment in view of its drawings.

SUMMARY OF THE INVENTION

The safety mechanism of this invention includes a plurality of warning devices that are spacedly arranged longitudinally along the exit ramp of a freeway, or even upon a one-way street, and which warning devices are arranged a sufficient distance, as from fifty to one hundred feet, more or less, from a detection means so that a flag or other barrier may be triggered into pivotal arrangement across the roadway and in front of the vehicle travelling in the wrong direction, the vehicle actuating the detection means to initiate this action. But, while the warning devices of this invention include the first pivotal movement of the barrier from a vertical and into a horizontal position, preferably perpendicularly across the roadway, further movement is incorporated within the structure of the device so as to allow for a horizontal pivot of the barrier along the roadway in the event that the vehicle should collide with the same before recognition of its warning.

The detection means of this invention may be of a variety of designs, with one including a series of protrusions arranged slightly above the roadbed of the exit ramp, and which when turned in one direction, that direction which is synomymous with the wrong way movement of a vehicle, it turns a pinion for drawing a rack and attached cable which pulls a bell crank for releasing a detent within the warning device. When this occurs, the detent releases an extension of another rack that is spring mounted and which when urged in one direction turns another pinion for pivoting the warning device or barrier into its operative position perpendicularly across the roadway. Another form of detection means includes an electronic or electric sensing device that may be arranged within the roadbed, such as a form of electromagnetic or resonant frequency detecting devices, as are available upon the market, or other forms of contacts that sense by sequence of movement the wrong way travel of a vehicle and energize one or more solenoids that can attract the detent into a disengagement, thereby allowing the warning device or barrier to once again pivot down into a horizontal position across the roadway, as aforesaid.

Further movement is provided within the structure of the warning device wherein a cylindrical member supports the rack and pinion arranged within the device, said support being made in the form of a bearing mount with an outer casing, with the bottom portion of said member, or its extension thereof, being secured with another pinion that engages a spring mounted rack. The relationship of this other pinion and spring mounted rack maintains the proper centering of the warning device or barrier perpendicularly across the roadway, but that upon its being contacted by a moving vehicle it allows for a pivotal movement of the cylindrical member, and the devices, horizontally approximately along the length of the roadway so as to allow the barrier to give and be urged out of position until the automobile either stops or clears the same.

Regardless of which style of detection means is utilized in the roadbed of the exit ramp, and even though other mechanisms may be considered for constructing the internal operations of the column supporting the warning device, the main concept of the invention is the provision of a plurality of pivotal movements for the barrier so as to first allow its actuation into an operative cautioning disposition, and its further pivoting in the event that the vehicle traversing in an incorrect direction collides with the same.

BRIEF DESCRIPTION OF THE DRAWINGS

In the drawings,

FIG. 4 provides a vertical cross sectional view of one of the columns of a warning device of this invention, a pair of such warning devices as shown in FIG. 1 being arranged laterally of the road;

FIG. 5 provides a cross sectional view of one of the bell cranks connecting with the cable and which is used for disengagement of the detent normally holding the warning device in its nonoperative position;

FIG. 6 discloses a side view of the barrier of a warning device;

FIG. 7 provides a plan view of the barrier of a warning device;

DESCRIPTION OF THE PREFERRED EMBODIMENT

Figure 1:
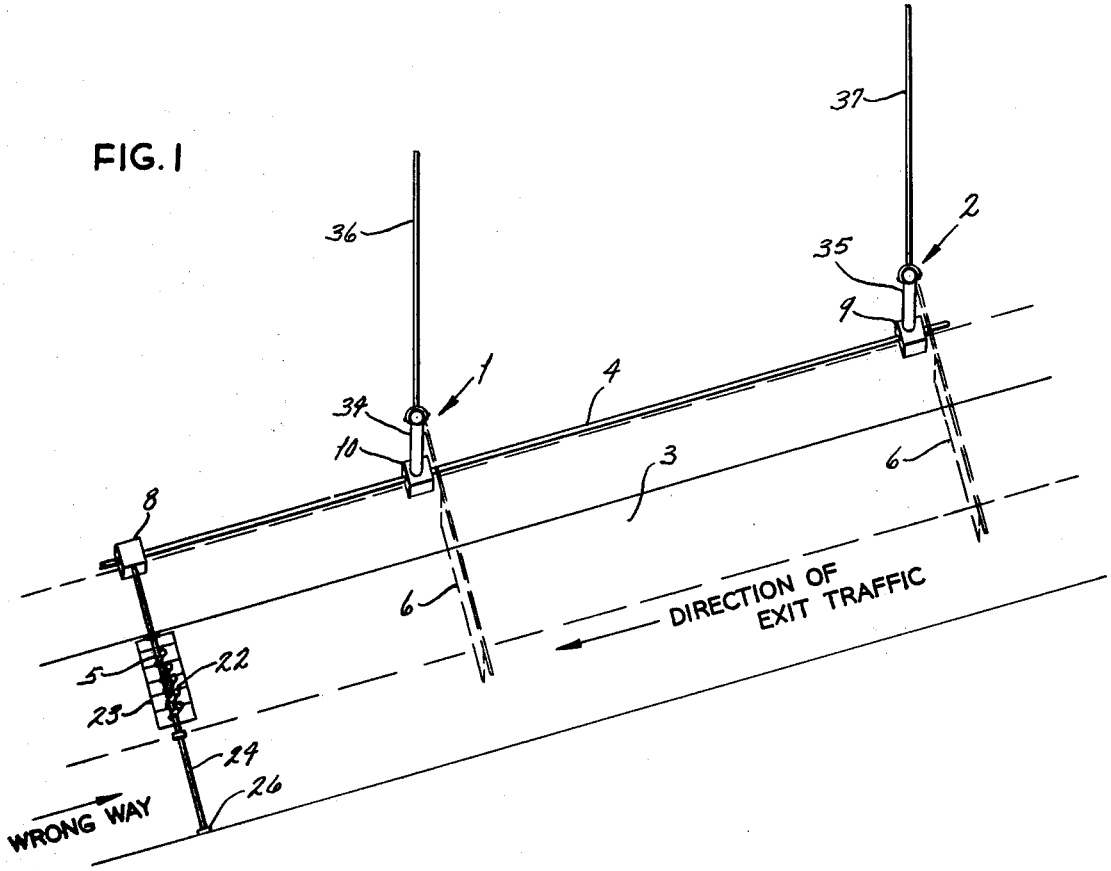
FIG. 1 discloses a schematic view of the arrangement of the detection means of this invention and a plurality of the warning devices positioned laterally of the roadway, and also shows in hidden line the perpendicular arrangement of its warning members as pivoted across the roadway.

In referring to the drawings, and in particular to FIG. 1, there is shown the safety mechanism of this invention which is generally depicted, in this display, as a pair of warning devices 1 and 2 that are arranged substantially adjacent to the roadbed 3 of an exit ramp to a freeway or other form of limited access highway. The main purpose of the invention is to prevent particular traffic from moving the wrong way upon the ramp and consequently attain access in the wrong direction upon the highway, a feat, which surprisingly, is performed more often than would be expected. The pair of warning devices 1 and 2 are interconnected together by means of a coupling means 4, which provides for simultaneous actuation of the warning devices when the detection means 5 senses the presence and the incorrect direction of movement of a vehicle thereacross. It may be commented that while this invention is primarily being described as a means for warning wrong way drivers traversing upon a ramp to a highway, it is just as likely that this invention could be utilized at other locations where accidents frequently occur due to the wrong direction of movement of a vehicle, such as upon some one-way streets. As further shown in this Figure, the warning devices may include some form of a suspended semaphore or flag 6, or any other form of cautioning display, so that the probably unalert driver will certainly become aware to the existence of these warning devices, which should impress upon him that something is wrong.

Figure 2:
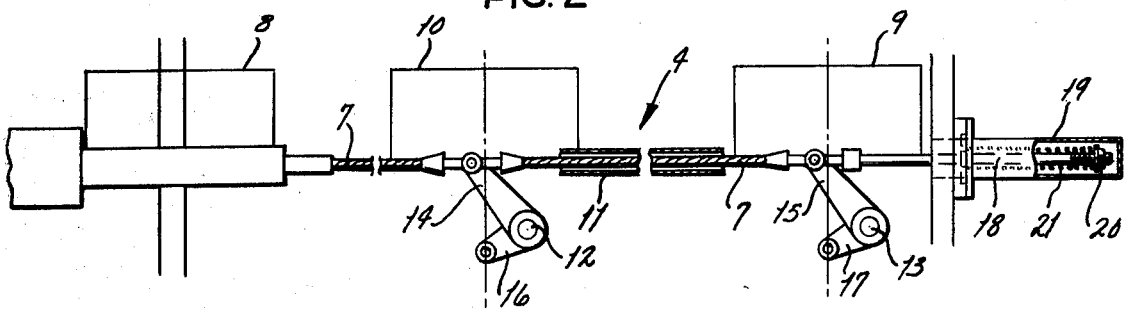
FIG. 2 discloses the arrangement of the cable that is used to trigger each of the warning devices in the event that a vehicle transverses in the wrong direction and encounters its detection means.

FIG. 2 provides a partial view of the coupling means 4 that interconnects between the detection means 5 and the warning devices 1 and 2 so as to provide for the latter's actuation. As shown, a cable 7 extends the full distance between the housing 8 that provides the mechanical coupling between the detection means 5 and its ability to move the cable 7 as required, and the base members 9 and 10 of the warning devices 1 and 2. A chase or other form of conduit 11 is provided for protecting the cable particularly at those locations between the housing 8 and the base members 9 and 10, primarily because the cable will usually be embedded underground, or if arranged above the ground, the cable will need the protection of the chase so as to prevent its being tampered with, or generally exposed to the elements. Connecting to the cable 7 approximately at the location of each base member 9 and 10 are bell cranks 12 and 13, which are fixed within the base members for pivotal movement about their centers, with one arm, as at 14 and 15, being connected to the cable 7 for movement therewith, while the other arms, as at 16 and 17, are arranged for connection with the mechanical components that operate within the warning devices 1 and 2. At the far end of the cable 7 a rod 18 connects therewith and extends into a housing 19, which is threaded at one end and secures an adjustable nut 20, and positions a spring 21 upon the rod for maintaining the proper tensioning of the cable 7 of the coupling means.

Figure 3:
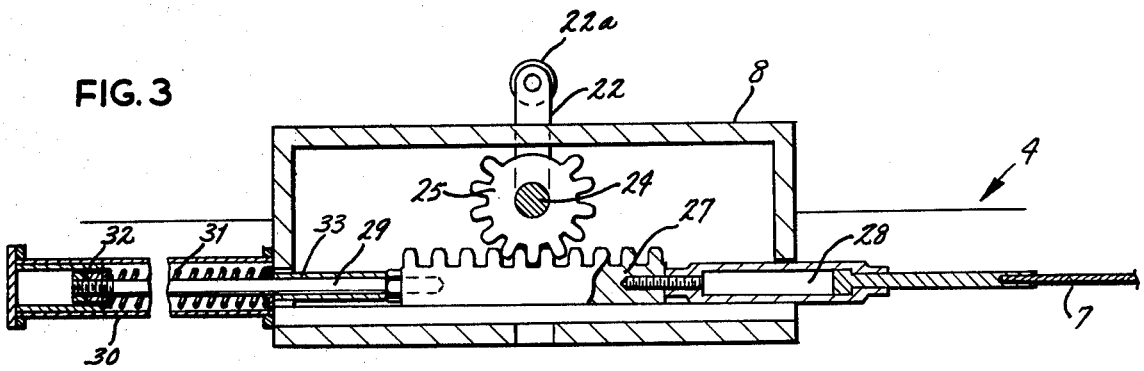
FIG. 3 provides a view of the mechanical style of detection means and its associated rack and pinion that achieves a pull of the cable of FIG. 2 upon its actuation.

At the other end of the coupling means 4, and as shown in FIG. 3, the cable 7 connects with the mechanical instrumentality within the housing 8 that converts the pivotal movement of the detection means 5 into a lineal pull of the cable 7. As can be seen, the detection means 5, in this particular instance being a mechanical form of detection means, there is included a series of protrusions or triggers 22 that extend upwardly through a grate like structure 23, so that when a vehicle pivots and depresses the protrusions 22, as in a clockwise direction, the shaft 24 mounting these protruding members 22 rotate a pinion 25 that is arranged within the housing 8. To facilitate the turn of these protrusions, rollers 22*a* or the like may be provided thereon. The shaft 24 is bearing mounted at both of its ends by mean by pillow blocks, such as the one shown at 26.

The pinion 25 intermeshes with the rack 26 that is arranged for longitudinal movement within the housing 8, with said rack at one end being connected by the linkage 28 to the cable 7. The rack 27 at its other end has a projecting rod 29 connected thereto, which extends outwardly into a closure 30, wherein a compression spring 31 is biased against a side of the housing 8, while its other end is compressed against the adjustable fastening means 32 thereby providing the means for providing further tensioning on the cable 7, and the proper positioning of the rack 27 with respect to its pinion 24. A guide sleeve 33 provides for the proper positioning of the rod member 29 and its connected rack 27, within the housing 8.

As can be seen from these two FIGS. 2 and 3, when the protrusions 22 are urged into a clockwise direction of movement, the rack 27 and its attached cable 7 are drawn towards the housing 8, thereby turning the belt cranks 12 and 13 in a manner that provides for a lowering of their integral arms 16 and 17. On the other hand, when the protrusions 22 are rotated in the opposite direction, as in a counterclockwise direction, the cable 7 will br urged to the right, or away from the housing 8, and provide for an opposite turn of the bell cranks 12 and 13, which have no effect upon the mechanisms contained within the warning devices 1 and 2, as will be hereinafter described.

Each of the warning devices 1 and 2 are composed of the base members 9 and 10, as previously explained, and each includes a column 34 and 35, having their warning members 36 and 37, respectively, pivotally mounted proximate their upper ends. These warning members are more accurately shown in FIGS. 6 and 7, and will be described later, but each may have a further suspending portion such as the flag, semaphore, or cautioning member 6 as previously explained.

Each of the columns 34 and 35 include their base members 9 and 10, and stationarily secured upwardly upon said bases is an outer casing 38 which mounts for pivotal movement on its upward edge a housing 39. Bearings 40 are provided for facilitating the pivotal movement of the housing 39 with respect to this outer casing. Arranged just interiorly of the casing 38 is a cylindrical member 41 that is pivotally mounted within the said outer casing 38 by means of a series of needle bearings 42 and 43. The housing 39 is rigidly secured to this cylindrical member 41 by means of a series of set screws 44, or the like.

The housing 39 is contoured to provide for its internally accommodating a pinion 45 which is pivotally mounted within the housing, and which has a shaft 46 extending from either of its sides for cooperatively mounting the clevis like members 47 of either of the warning members 36 and 37. See also FIGS. 6 and 7. These warning members are fastened within the clevis 47 by means of a series of fasteners 48. In addition, other fastening means may be provided within the apertures 49 and 50 for securing the clevis like member to the lateral extensions of the pinion shaft 46.

The pinion 45 intermeshes with a rack 51, within the housing 39, with a centering roller 52 provided therebehind for properly positioning of said rack 51. The rack 51 includes a lower extension, such as the tube 53, and is threadedly engaged thereto as at 54. A split adjustable nut 55 further secures the positioning of these two components together. In addition, a sleeve 56 is further threadedly engaged with the tube 53, and together these components are centered within the cylindrical member 41 by means of the annular shoulder 57 integrally formed of the member 41. The downward end of the sleeve 56 connects with a ring seat 58, and biasing against the lower surface of this seat is a compression spring 59. A second annular lower shoulder 60 is provided integrally with the cylindrical member 41, and upon this shoulder rests an additional ring seat 61, and against which the lower end of the spring 59 contacts. Thus, it can be seen that the compression spring 59 is constantly biasing the rack 51 and its lower extension or tube 53 upwardly within the column, having a tendency to urge a pivot of the pinion 45 into a clockwise or warning member lowering position horizontally across the roadway of the ramp. The upper edge of the seat 58 in engaging the shoulder 57 is one means for limiting the upward movement of the rack 51.

The lower end of the rack extension or tube 53 slidably inserts through another sleeve 62 which cooperates with the shoulder 60 for providing proper centering of the tube centrally within the cylindrical member 41. Another split adjustable nut 63 is threadedly engaged upon the tube 53, and provides another means for limiting the upward movement of said tube within the column. The lower end of the tube 53 is secured with a downward extending portion or sleeve 64, which is secured thereto by means of a weld 65 or the like. Arranged within the sleeve 64 is another downwardly extending part 66, which is actually separate from the tube 53, and capable of axially slidable movement therein, forming part of the detent mechanism of this device. This detent part 66 includes a reduced diameter portion, or relief, as at 67, within which a series of roller bearings, as at 68, may slide with clearance, as will be hereinafter described. These roller bearings 68 rest within seats provided within the lower portion of the sleeve 64, as shown in FIG. 4. Further surrounding the sleeve 64 is an additional or outer sleeve 69, which is provided with a shoulder 70, as shown. This sleeve 69 rigidly secures with a ring 71 that is fastened to the downward end of the cylindrical member 41, and which is disposed for pivotal movement therewith.

This detent part 66, with its reduced diameter portion 67, in addition to the sleeve 64, and the outer sleeve 69, cooperate with the roller bearings 68 to form the detent means of this invention. This detent means operates as follows. When these cooperating components are in the position as shown in FIG. 4, the rack 51 and its lower extension or tube 53 are held downwardly within the column by means of the engagement of the roller bearings 68 against and under the shoulders 70 of the outer sleeve 69. But, when the bell cranks 12 or 13, as shown, are pulled by means of the cable 7 in one direction, as previously analyzed, they draw down upon this detent part 66, against the bias of the compression spring 72, until such time as the reduced diameter portion 67 becomes arranged adjacent the ball bearings 68, which are then free to slide into these slots or the reduced diameter portion 67 providing for disengagement of the said bearings from the shoulder 70 of the outer sleeve 69. Hence, the bearings 68 and the sleeve 64, in which said bearings are seated, are then clear and free to shift upwardly with the lower rack extension or tube 53, by means of the upward bias of the compression spring 59, thereby shifting the rack 51 upwardly within its housing, thereby turning its pinion 45 approximately 90 degrees for arranging the warning member 36 or 37 horizontally and perpendicularly across the roadway. The upward limit to the reduced diameter portion 67, as shown by the beveled portion 73 of the detent part 66, provides another means for limiting the upward movement of the said rack 51. The compression spring 72 is mounted upon a pin 74 so as to provide an extended positioning of the part 66 in an upward direction. To reset the detent means, and to once again pivot the warning devices 36 and 37 into their nonoperative or upward directions, as shown in FIG. 1, one needs simply to manually pivot these warning members into an upright or vertical disposition, thereby forcing the pinion 45 to urge the rack 51 downwardly within the column, until such time as the sleeve 64 and its roller bearing 68 are forced sufficiently downwardly within the outer sleeve 69 so as to provide for an engagement of said bearings against the shoulder 70. To facilitate this, the part 66 may be forced slightly downwardly against the spring 72 and its pin 74, at least until the lower beveled portion 73*a* drops below the shoulder 70 of the outer sleeve 69. After the bearing 68 move out against this shoulder 70, the lower detent part 66 will be urged upwardly within the sleeve 64 by means of the spring 72 so as to provide the upward disposition of its reduced diameter portion or relief 67 above the positioning of these roller bearings 68.

Another main feature of this invention is the provision for the horizontal pivot of the warning device or member substantially in a direction along the length of the ramp or roadway, and this arrangement is provided through the agency of another or second pinion provided within the columns 34 and 35, or arranged just below thereof within the housings 9 or 10, and this pinion 75 is disposed for engagement with a rack 76, which rack has a rod 77 extending from one end and into a cover 78. The back end of said rod is threaded so as to receive a pair of adjustable lock nuts 79 that retain a centering spring 80 against the side of the housings 9 or 10, and thereby provide for the convenient centering of the rack with respect to a pinion 75. Since the pinion 75 is rigidly connected to the ring 71, which as previously analyzed, is secured to the lower end of the cylindrical member 41, when any force is exerted upon the warning devices 36 and 37, it causes a turning of the housing 39, which results in a concomitant turn of the bearing mounted cylindrical member 41, and its associated pinion 75, with respect to the said rack 76. As the rack is shifted one way or the other within the housing, its fixed spring 80 will have a tendency to recenter the warning device after it has been released from the force it has encountered.

FIG. 5 discloses the relationship of one of the bell cranks 12 or 13 in its setting with respect to the cable 7, and how it connects with the downward end of the detent part 66 and its associated components. As can be seen, the bottom end of this part 66 engages with a threaded cap. And, the slidable pin 74 therein connects with the link 81 associated with the bell crank. As can be seen, the bell cranks pivotally mount and are secured to the bottom of their respective housings 9 and 10. Thus, when the cable 7 is pulled towards the housing 8, it results in a downward pull of the link 81 which causes a draw down of the pin 74 and the detent 66 for eventual releasing of the roller bearing 80 into the reduced diameter portion 67.

Figure 8:
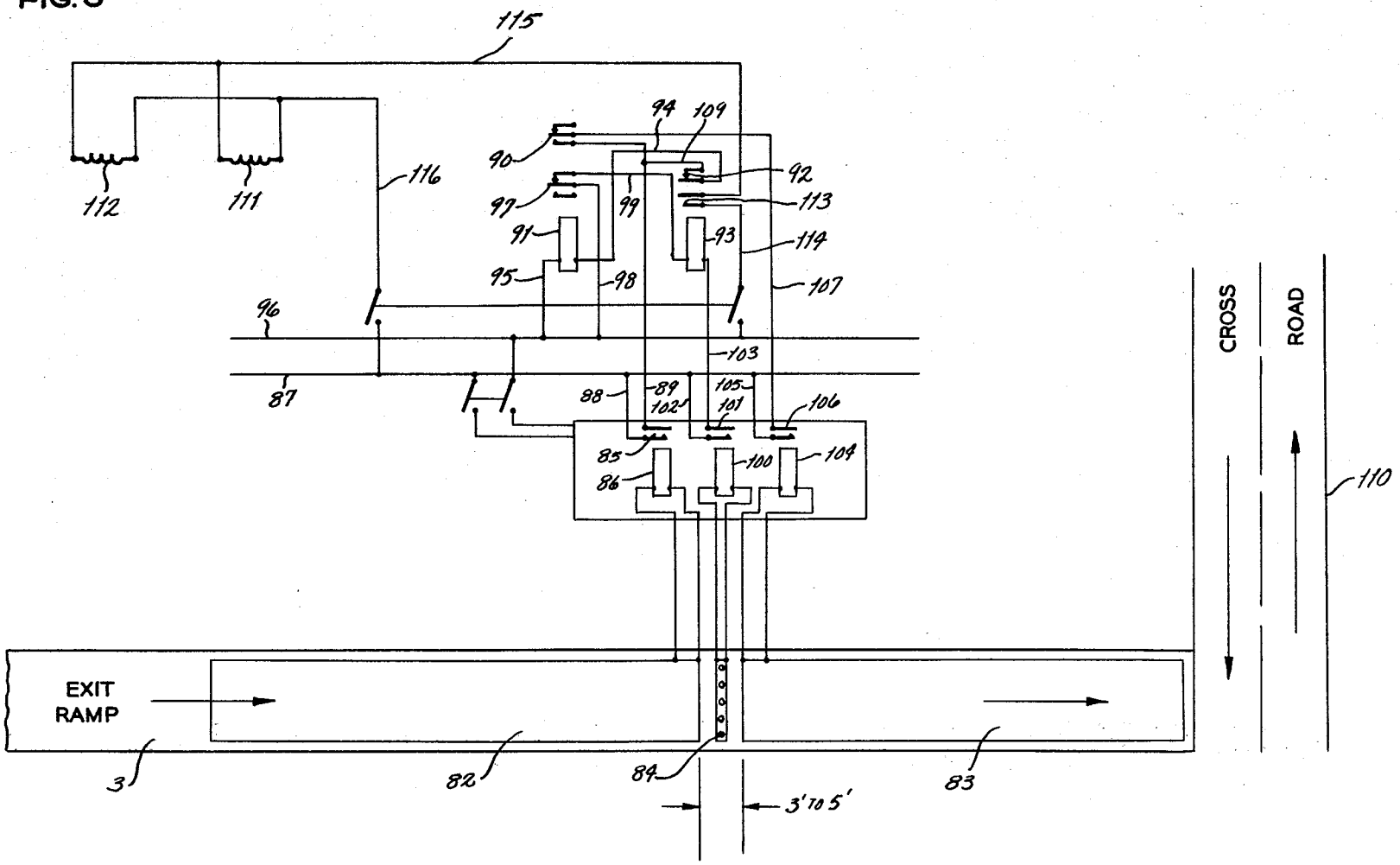
FIG. 8 provides a circuit diagram of an electrical form of detection means useful for sensing the wrong way movement of traffic, and for providing an actuation of a warning device in the event thereof.

Another form of the detection means, more specifically of the electrical type, is shown in FIG. 8. This particular arrangement utilizes a series of coils 82 and 83 that are embedded within the surface of the roadway 3. These coils are identified as digital four channel loop inductive detectors, and function to detect an automobile as it crosses thereover and disrupts its normally resonant frequency. Between the coils is a controller or proximator. This proximator is identified as functioning upon electromagnetic coils and forces that can detect the passage of an automobile thereacross. This combination of coils and controller are readily available from the Canoga Controls Corporation of Canoga Park, California. When an automobile traversing in the proper direction upon the roadway 3 contacts the coil 82, it effects a closing of the normally opened contacts 85 of the coil relay 86, thereby drawing current from line 87 through the circuit line 88 and through these contacts 85, which further sends current through the circuit line 89 to the normally opened contracts 90 of the coil relay 91. Current also is conducted to the normally closed contacts 92 of the power relay 93, by way of the circuit line 94, and also to the coil of the relay 91. The other side of the relay coil 91 is connected by way of the circuit line 95 to the supply line 96 for thus energizing the coil of the relay 91, thereby closing the normally opened contacts 90 and opening the contacts 97. The opening of the normally closed contacts 97 of the relay 91 prevents current from being conducted from the supply line 96, and also through the circuit line 98, and the contacts 92, in addition to the line 99, or to the coil of relay 93. Thus, power relay 93 cannot operate.

As the vehicle continues to move properly down the exit ramp and starts to cross the proximator 84, it energizes the coil of the relay 100 thereby closing the normally opened contacts 101 and in turn sends current from the line 87, by way of the circuit line 102 to the circuit line 103 and to the relay 93. As the vehicle crosses the proximator coil 84 a portion of said vehicle is still influencing the coil 82, thereby keeping the coil of the relay 91 energized, thereby holding the normally closed contacts 97 open, thus preventing operation of the power relay 93. As the vehicle proceeds properly down the exit ramp and influences the controller 83, while simultaneously influencing the controller 82 and the proximator 84, this causes an energization of the coil of the relay 104, thus sending current from the line 87 through the circuit line 105 and through the normally opened but now closed contacts 106 to the circuit line 107 and to the normally opened contacts 90 which are now closed by operation of the controller 82. As a result, current then traverses through the line 108 and 109, through the contacts 92 of the relay 93, which is not operating at this time, but also continues through the circuit line 94 to the coil of the relay 91, and further through the circuit line 95 communicating with the supply line 13, thus becoming a holding circuit for the coil relay 91. As the vehicle proceeds further down the ramp leaving the controller coil 82, and also the proximator 84, but is still riding upon the controller coil 83, it thus holds the relay 91 and its contacts 90 for completing the holding circuit. As the vehicle continues further down the ramp exiting onto the cross road 110, and thereby leaving the influence of the controller coil 83, all of the aforesaid circuits return to their normal and stable condition. The above procedure operates similarly if only one vehicle is on the ramp, or if the ramp is completed filled with a plurality of exiting vehicles.

In the event that a vehicle commences to proceed from cross road onto the exit ramp, thereby travelling in an incorrect direction, it immediately influences the controller 83 and energizes its relay 104, thereby closing the normally opened contacts 106 for drawing current from the supply line 87 through the circuit line 105, and in through the normally opened contacts 90 of the coil relay 91, ending the transfer of any charge through the circuit line 107. As the vehicle proceeds up the exit ramp, as in the wrong direction, and crosses the proximator coil 84, it energizes the coil of the relay 100 thereby closing its contacts 101 resulting in a drawing of a current from the supply line 87 and through the circuit line 102, its contacts 101, and then through the line 103 for passage to the coil of the relay 93. This power relay 93 with its contacts are capable of handling the surge of current provided for the operation of a pair of solenoids as at 111 and 112, each solenoid which respectively would be associated to pull the cable 7 or the bell cranks 12 and 13 of the columns 34 and 35. The current from the coil of the relay 93 is further conducted through the circuit line 99 and through the normally closed contacts 97 for conduct through the circuit line 98 to the supply line 96, thereby completing the circuit and closing the normally opened contacts 113 for drawing current from the supply line 96 and through the circuit line 114, further through the contacts 113, and to the circuit line 115 for energization of the two solenoids 111 and 112, which are connected in parallel to the circuit line 116 to the circuit line 87. The switches 117 are manual switches that can initially be actuated for adding or removing this electrical detection means from the safety system of this invention. This completes the circuitry of the electrical form of the detection means for this invention. As the circuit is completed, as aforesaid, one of or both of the solenoids 111 and 112 are coupled to and actuate release mechanisms, such as the bell cranks 12 and 13, that are capable of releasing the detent means of each column as previously analyzed. When this occurs the warning devices 36 and 37, including any of their depending cautioning flags or semaphores 6 or the like, become arranged horizontally across the roadway so as to caution the driver of an incorrect direction of movement. As desired, this effects a complete stoppage of all traffic travelling upon the roadway 3, thereby immediately avoiding the chances for any head-on collisions upon the ramp, and more importantly, eliminating the access of the wrong-way driver onto the freeway where much more serious accidents would eventually occur.

The foregoing description of the preferred embodiment of this invention, in addition to its summary, defines one example of how this invention may operate. This description is set forth for illustration purposes. Obviously, other variations or changes to the structure of this embodiment may occur to those skilled in the art upon reviewing the description of this embodiment. Any such changes or variations that come within the spirit and scope of this invention, and which are encompassed within the claims appended hereto, are intended to be protected by any patent issuing hereon. To reiterate, the foregoing disclosure and description are made for illustration purposes only.

Having thus described the invention what is claimed and desired to be secured by Letters Patent is:

1. A warning device for alerting a driver of a vehicle as to the vehicle's incorrect direction of movement upon an exit ramp or other roadway comprising detection means provided within the roadway and of the type capable of sensing the presence and incorrect direction of movement of a vehicle thereacross, a warning member and a support column therefor, said warning member and support column being supported laterally of the ramp or other roadway, said warning member being pivotally mounted upon said column and capable of being disposed in a nonoperative position and then pivoted into a horizontal position operatively across the roadway when actuated by the said detection means, said warning member and column includes a base, said column being fixed to the base, a housing provided upwardly of said column, said housing including a rack and pinion, said warning member being mounted to said pinion for pivotal movement therewith, said rack having an extension from its lower end, a detent means operatively associated with the rack extension and normally retaining said warning member in its nonoperative position, spring means operatively associated with said extension and normally biasing said warning member into its operative position upon release of said detent means in response to the detection means, coupling means interconnecting between the detection means and the column for initiating the operative pivotal positioning of said warning member, and said warning member capable of resiliently pivoting horizontally substantially along the length of the roadway when contacted by a vehicle.

2. The invention of claim 1 wherein there are a pair of said warning members and supporting columns provided spacedly along the length of the ramp with said warning members being actuated in response to the detection means.

3. The invention of claim 1 wherein said spring means surrounds the rack extension.

4. The invention of claim 1 wherein said detent means is a ball detent.

5. The invention of claim 4 and including a length of sleeve concentrically arranged around a part of said detent means associated with said rack extension, said sleeve having a shoulder provided thereon, at least one ball means normally resting against said shoulder and upon the surface of said detent to prevent the upward movement of said rack, said detent means having a reduced diameter portion provided therein for accommodating said ball means for clearing said shoulder and allowing said rack to shift upwardly under the influence of said spring means to provide pivoting of said warning member into its operative position across the ramp.

6. The invention of claim 5 wherein said detent means includes a part that is separable from the rack extension, said part having the reduced diameter portion provided therein, a second spring means normally biasing said part upwardly within the extension, whereby upon the downward draw of said detent part said ball means enters into its reduced diameter portion thereby allowing said rack and its extension to shift upwardly under the influence of said first spring means for pivoting the warning member into its operative position across the ramp.

7. The invention of claim 6 wherein said rack extension includes a seat for reception of the ball means and thereby fixing its longitudinal positioning with respect to the said extension.

8. The invention of claim 1 wherein said column includes an outer casing, said casing being secured to said base, said housing and rack extension being pivotally mounted within said outer casing, another spring means normally centering the housing and rack extension with respect to the outer casing for maintaining the warning member across the ramp but allowing its horizontal pivot as when struck by a vehicle.

9. The invention of claim 8 and including a second rack and pinion operatively associated with the rack extension, said another spring means positioning said pinion with respect to its rack but allowing its shifting upon the horizontal pivoting of the warning member substantially along the length of the ramp as when struck by a vehicle.

10. The invention of claim 9 and including a cylindrical member mounting said housing and supporting the rack extension therein, said cylindrical member being bearing mounted within the outer casing and capable of pivotal movement with respect thereto, the pinion of the second rack and pinion being mounted proximate the lower end of the cylindrical member, wherein the rack and said another spring means normally centers the warning member across the ramp but allows its pivotal shifting with respect thereto as when said warning member is struck by a vehicle.

11. The invention of claim 1 wherein said detection means includes at least one protrusion extending into the roadway, said protrusion connecting with a pinion of another rack and pinion provided laterally of the said roadway, said coupling means connecting with the rack and being pulled by the same upon pivot of its pinion when the roadway protrusion is encountered by a vehicle travelling in an incorrect direction, said coupling means including a cable connecting with said rack, a bell crank also connecting with the detent means and inducing its release upon a pull of the cable in one direction.

12. The invention of claim 1 wherein said detection means includes a series of sensors provided upon the roadway, at least one solenoid operatively associated with the detent means, said sensors providing for energization of said solenoid upon detecting the incorrent movement of a vehicle upon the ramp, said solenoid upon its energization providing for a release of the detent means and the pivotal disposition of the warning member in a cautioning position across the roadway.

13. The invention of claim 12 wherein there is a solenoid associated with each detent means.

* * * * *